US007739980B2

(12) United States Patent
Kim et al.

(10) Patent No.: US 7,739,980 B2
(45) Date of Patent: Jun. 22, 2010

(54) APPARATUS FOR MANUFACTURING STEEL TUBE AND METHOD FOR MANUFACTURING THE SAME

(75) Inventors: Gi Hyeoug Kim, Pyongtaek (KR); Kyung Yun Kim, Pyongtaek (KR); Yong Kil Kim, Pyongtaek (KR); Sun Chang Kim, Pyongtaek (KR); Jae Pyeong Sim, Pyongtaek (KR); Jong Seo Kim, Pyongtaek (KR)

(73) Assignee: Korea Bundy Co., Ltd., Pyongtaek-City (KR)

( * ) Notice: Subject to any disclaimer, the term of this patent is extended or adjusted under 35 U.S.C. 154(b) by 804 days.

(21) Appl. No.: 11/465,813

(22) Filed: Aug. 21, 2006

(65) Prior Publication Data

US 2007/0050967 A1 Mar. 8, 2007

(30) Foreign Application Priority Data

Sep. 2, 2005 (KR) ..... 10-2005-0081691

(51) Int. Cl.
*B05C 3/12* (2006.01)

(52) U.S. Cl. ..... 118/405; 118/420; 118/63

(58) Field of Classification Search ..... 118/420, 118/405, 63, 693, 694; 148/519, 521, 531, 148/533, 537, 590, 591; 72/38, 68, 200–202, 72/236, 342.1–342.96, 364, 367.1, 368; 29/33 D, 29/460, 527.1

See application file for complete search history.

(56) References Cited

U.S. PATENT DOCUMENTS 3,231,708 A * 1/1966 Beaudoin et al. ..... 219/643
3,738,312 A * 6/1973 Padjen et al. ..... 118/672
3,845,540 A * 11/1974 Rossi et al. ..... 29/430

* cited by examiner

*Primary Examiner*—Brenda A Lamb
(74) *Attorney, Agent, or Firm*—Nixon Peabody LLP; Jeffrey L. Costellia

(57) ABSTRACT

An apparatus and method for manufacturing a steel tube are provided. The apparatus includes: a tube-forming device for forming a steel plate into a steel tube; a heat treatment device connected in-line to the tube-forming device to heat the steel tube to a high temperature; a pre-treatment device for annealing the steel tube and providing a reduction atmosphere; and a plating device including a pot for storing a SeAHLume alloy composed of aluminum and zinc in a molten state, a level block selectively inserted into the molten alloy to adjust a level of the molten alloy, and a plating part into which the molten alloy flows in response to insertion of the level block and through which the steel tube passes substantially vertically. Therefore, it is possible to manufacture a steel tube having a plated surface to improve its corrosion-resistance.

3 Claims, 3 Drawing Sheets

APPARATUS FOR MANUFACTURING STEEL TUBE AND METHOD FOR MANUFACTURING THE SAME

CROSS-REFERENCE TO RELATED APPLICATION

This application claims the benefit of Korean Application No. 10-2005-81691, filed on Sep. 2, 2005, which is hereby incorporated by reference as if fully set forth herein.

BACKGROUND OF THE INVENTION

1. Field of the Invention

The present invention relates to an apparatus and method for manufacturing a steel tube, and more particularly, an apparatus and method for manufacturing a steel tube having an improved surface treatment structure.

2. Background of the Related Art

Generally, methods for manufacturing a steel tube include an injection method and a method of forming a steel plate into a tube shape. Since the injection method is more costly, the method using a steel plate is widely used.

The steel tube manufactured by the steel plate method is referred to as an electric-welded tube, since the steel plate is deformed into a tube shape and its ends are welded together using an electric-resistance welding method.

The method for manufacturing an electric-welded tube is widely employed in most steel tube manufacturing methods, from small to large diameter tubes. A small diameter steel tube manufactured as described above is widely used in a condenser of a cooling apparatus such as a refrigerator, a hydraulic line of a brake system, and other such applications which require high durability and reliability. Therefore, such a small diameter steel tube should be manufactured carefully.

Meanwhile, in order to prevent surface corrosion of a small diameter steel tube, research into more effective surface treatment technology is ongoing.

SUMMARY OF THE INVENTION

Therefore, the present invention has been made in view of the above problems, and it is an object of the present invention to provide an apparatus and method for manufacturing a steel tube, a surface of which is plated to have improved corrosion resistance.

According to an aspect of the present invention, an apparatus for manufacturing a steel tube comprises: a tube-forming device for forming a steel plate into a steel tube; a heat treatment device connected in-line to the tube-forming device to heat the steel tube to a high temperature; a pre-treatment device for annealing the steel tube and providing a reduction atmosphere; and a plating device including a pot for storing a SeAHLume alloy composed of aluminum and zinc in a molten state, a level block selectively inserted into the molten alloy to adjust a level of the molten alloy, and a plating part into which the molten alloy flows in response to insertion of the level block and through which the steel tube passes substantially vertically.

According to another aspect of the present invention, a method for manufacturing a steel tube comprises: a first step of forming a steel plate into a steel tube; a second step of connecting the formed steel tube to substantially vertically pass through a plating part; a third step of melting a SeAHLume alloy composed of aluminum and zinc; a fourth step of inserting a level block into the molten alloy to raise a level of the alloy to introduce the molten alloy into the plating part; and a fifth step of moving the steel tube through the plating part and injecting a gas into the moving steel tube to adjust the thickness of the alloy plated on the steel tube.

According to yet another aspect of the present invention, a method for manufacturing a steel tube comprises: a first step of forming a steel plate into a steel tube; a second step of heating the steel tube to a high temperature to perform heat treatment; a third step of annealing the steel tube and providing a reduction atmosphere; a fourth step of melting a SeAHLume alloy composed of aluminum and zinc, and vertically passing the steel tube through the molten alloy to plate a surface of the steel tube with the molten alloy; and a fifth step of cooling the steel tube.

BRIEF DESCRIPTION OF THE DRAWINGS

The above and other aspects and advantages of the present invention will become apparent and more readily appreciated from the following description of exemplary embodiments, taken in conjunction with the accompanying drawings of which.

DETAILED DESCRIPTION OF EXEMPLARY EMBODIMENTS

Figure 1:
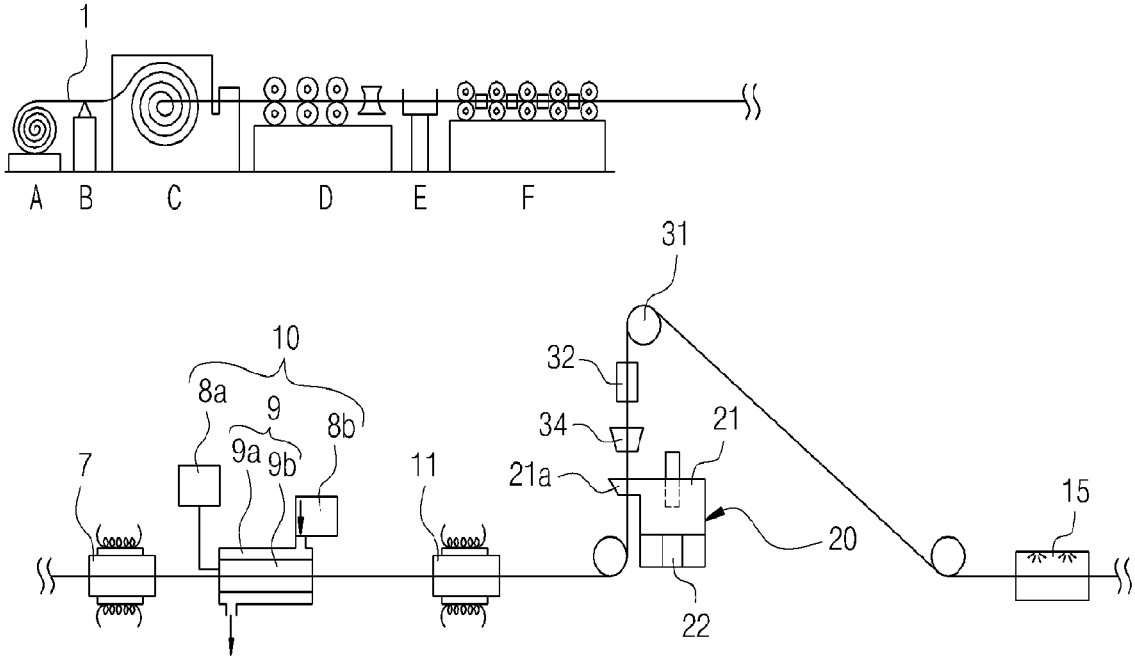
FIG. 1 is a schematic view of an apparatus for manufacturing a steel tube in accordance with an exemplary embodiment of the present invention.

Exemplary embodiments of the present invention will now be described in detail with reference to the accompanying drawings, throughout which like reference numerals refer to like elements.

Hereinafter, an apparatus for manufacturing a steel tube in accordance with an exemplary embodiment of the present invention will be described in detail with reference to the accompanying drawings.

FIG. 1 is a schematic view of an apparatus for manufacturing a steel tube in accordance with an exemplary embodiment of the present invention.

As shown in FIG. 1, an apparatus for manufacturing a steel tube in accordance with an exemplary embodiment of the present invention includes a tube-forming device for forming a steel plate into a steel tube, and a device for plating a surface of the steel tube with an alloy, the two devices integrally formed in a single line. As a result, the entire manufacturing process of the steel tube can be performed rapidly on a single line, thereby improving productivity.

As shown, the tube-forming device may include an uncoiling device A for flattening a coiled steel plate, a butt welding device B for welding a plurality of steel plates together, a looping device C for discharging the welded steel plates while maintaining a looped state of the steel plates in order to uniformly supply the steel plates, an electric-resistance welding device D for forming the steel plate into a tube and welding its juncture, a cooling device E for cooling the formed steel tube to an appropriate temperature, and a reducing device F for reducing the diameter of the steel tube to a certain standard.

Here, the cooling device E may further include a cutting device for smoothly cutting a bead part of the steel tube 1, i.e., a welded part, to prevent generation of defects in the steel tube during the following plating process. In addition, after reducing the steel tube 1, a surfactant is used to chemically treat a surface of the steel tube 1. Then, foreign substances such as oxide attached to the surface of the steel tube are physically removed by a rapidly rotating wire brush, etc., and the surface of the steel tube is cleaned using water and air.

Next, the steel tube 1 passes through a heat treatment device 7, a pre-treatment device 10, and a plating device 20, and a SeAHLume alloy is plated on the surface of the steel tube 1.

Specifically, the steel tube 1 is heated to a high temperature of 750~850° C. using an induction coil of the heat treatment device 7, thereby being heat treated to improve mechanical properties of the steel tube 1.

Then, the steel tube 1 passes through the pre-treatment device 10, which includes a dual tube 9, a gas injection device 8*a*, and a cooling water supply device 8*b*.

In this process, the dual tube 9 includes an inner tube 9*b* surrounding the steel tube 1, and an outer tube 9*a* disposed around the periphery of the inner tube 9*b*. The steel tube 1 moves through the center of the inner tube 9*b*. At this time, a mixed gas is supplied into the inner tube 9*b* by the gas injection device 8*a* to form a reduction atmosphere.

The mixed gas is formed of 10~30% reduction gas such as hydrogen, and 70~90% inert gas such as nitrogen. Flow rates of the hydrogen and nitrogen may be adjusted by controlling flow meters after regulating the pressure in each tube. And, the gas whose flow rates are adjusted may be mixed and passed through a single mixed gas tube.

The reduction atmosphere described above can prevent black oxidation of the surface of the heated steel tube, thereby enabling the following plating process to be performed more stably.

In addition, cooling water is supplied between the inner tube 9*b* and the outer tube 9*a* to anneal the steel tube 1 to about 570~620° C. For this purpose, a space between the inner tube 9*b* and the outer tube 9*a* is connected to the cooling water supply device 8*b* for supplying cooling water which absorbs heat and discharges it to the exterior. In addition, the steel tube 1 may be pre-heated by an optional pre-heating device 11.

Meanwhile, the plating device 20 is a device for plating the surface of the steel tube 1 with a corrosion-resistant alloy, and may include a heater 22 and a pot 21 for storing molten alloy. The alloy (referred to as a SeAHLume alloy) includes 55 wt % aluminum and 43.4~44.9 wt % zinc, which has excellent corrosion-resistance. In addition, the alloy may further include 0.1~1.6 wt % silicon. Further, the heater 22 may be installed at a lower part of the pot 21 for melting the alloy using an induction heating method.

Furthermore, the pot 21 is a vessel for storing the molten alloy and may include a plating part 21*a* projecting from its one side and disposed on a path through which the steel tube 1 passes. That is, a portion of the molten alloy is introduced into the plating part 21*a*, and the surface of the steel tube 1 moving through a hole formed at the plating part 21 a is plated with the alloy.

Here, the path along which the steel tube 1 passes through the plating part 21*a* may be vertical. That is, the steel tube 1 may be vertically moved between an upper guide roller 31 and a lower guide roller 30, thereby preventing the alloy from being unevenly plated due to gravity.

After vertically raising the steel tube 1, the steel tube 1 is lowered by the upper guide roller 31 at a predetermined angle to be moved to the following process. When the steel tube 1 arrives at a horizontal moving region, it is cooled by an air-cooling or water-cooling device 15. The cooling process may be performed by blowing air and/or spraying water onto the surface of the steel tube 1 (quenching).

The steel tube 1 manufactured by the above devices is tested for leakage and then wound into a coil in order to be moved to following process. Then, in order to prevent discoloration such as blacking or white rust on the plated surface of the steel tube 1, a $Cr^{3+}$ chromating process may be performed on the surface of the steel tube 1 by a chromating device for 5 seconds or less, and preferably 1 second or less.

Figure 2:
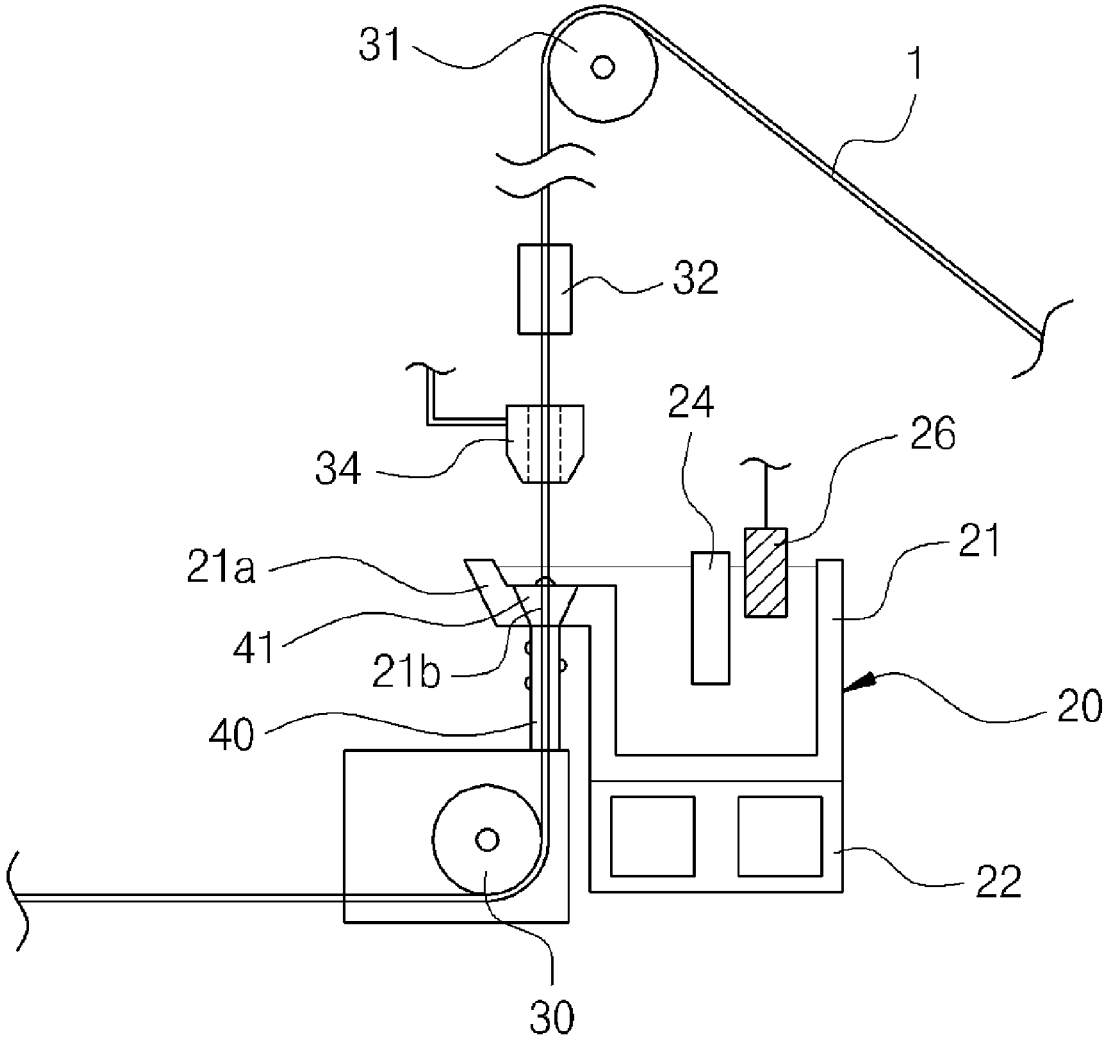
FIG. 2 is a cross-sectional view of a plating apparatus in accordance with an exemplary embodiment of the present invention.

Meanwhile, FIG. 2 is a cross-sectional view of a plating apparatus in accordance with an exemplary embodiment of the present invention. The constitution of the plating device will now be described in detail with reference to FIG. 2.

As shown in FIG. 2, the induction heater 22 is installed at a lower part of the pot 21, and the plating part 21*a* projects from one side of the pot 21.

Preferably, the steel tube 1 vertically passes through the path of the plating part 21*a*, which includes the upper and lower guide rollers 31 and 30 installed at upper and lower ends thereof to guide movement of the steel tube 1. For this purpose, before performing the plating operation, the formed steel tube 1 should be connected at both sides to vertically pass through the plating part 21*a*.

As shown, the steel tube 1 is introduced under the lower guide roller 30 horizontally, and bent upward to be moved substantially vertically. The lower guide roller 30 is surrounded by a case which may include an auxiliary tool for adjusting a gap due to a diameter difference of the steel tube 1.

Then, the steel tube 1 passes through the plating part 21*a* to be plated with a SeAHLume alloy composed of 55 wt % aluminum and 43.4~44.9 wt % zinc. The alloy may further include 0.1~1.6 wt % silicon. Meanwhile, there is no need to always store the molten alloy in the plating part 21*a*, and a level of the molten alloy introduced into the plating part 21*a* can be adjusted by a level block 26, which may be selectively inserted into the pot 21.

Specifically, the pot 21 includes a partition 24 installed therein to divide an upper space, and the level block 26 is installed to be vertically movable at one side of the partition 24. The partition 24 prevents waves in the molten alloy around the plating part 21*a* due to vertical movement of the level block 26. When the level block 26 is moved downward to be dipped in the molten alloy, the level of the molten alloy is raised to introduce the molten alloy into the plating part 21*a*. On the other hand, when the level block 26 is moved upward, the level of the molten alloy is lowered to remove the molten alloy from the plating part 21*a*.

Meanwhile, the plating part 21*a* has a hole 21*b* at its bottom surface for the steel tube 1 to pass through, and a pressure regulation device for preventing leakage of the molten alloy through the hole 21*b*. The pressure regulation device may include a lower nozzle device 41 and a guide pipe 40.

Here, the guide pipe 40 is connected to the case surrounding the lower guide roller 30, and an inert gas such as nitrogen is supplied into the guide pipe 40 at a pressure of 0.1~0.3 bar to maintain a pressure higher than atmospheric pressure. In addition, the guide pipe 40 is in communication with the lower nozzle device 41 at its upper end, and the lower nozzle device 41 is also maintained at a high pressure to prevent the molten alloy in the plating part 21*a* from leaking downward.

As described above, by adjusting the pressure in the pressure regulation device including the guide pipe 40 and the lower nozzle device 41, it is possible to uniformly plate the steel tube 1 vertically passing through the plating part 21*a* with the molten alloy, and prevent downward leakage of the molten alloy.

In addition, guide nozzles may be installed at upper and lower parts of the lower nozzle device 41 and replaced as necessary to fit the outer diameter of the steel tube 1.

As described above, since the steel tube 1 is vertically moved in a direction opposite to gravity, the steel tube 1 can be uniformly plated with the molten alloy while passing through the plating part 21*a*. That is, the molten alloy plated on the steel tube 1 can flow downward due to the gravity, thereby preventing the steel tube 1 from being plated with uneven thickness.

In addition, an upper nozzle device 34 may be installed over the plating part 21*a* to inject air or other mixed gas. In order to prevent oxidation of the upper nozzle device 34, a small amount of hydrogen gas may be supplied to the steel tube 1 to generate a flame. Further, an inert gas such as nitrogen may be blown onto the steel tube 1 through the upper nozzle device 34 to adjust the thickness of the alloy plated on the steel tube 1.

Meanwhile, the steel tube 1 passed through the plating part 21*a* is continuously moved vertically upward a distance of about 20 m. At this time, at least one tubular cooling device 32 is installed along the moving path to surround the steel tube 1. Therefore, the surface of the steel tube 1 can be cooled to a predetermined temperature or lower by the air blown from the tubular cooling device 32.

In addition, the upper guide roller 31 is installed at an upper end of the moving path of the steel tube 1, and the steel tube 1 is bent by the upper guide roller 31 to form an acute angle of less than about 30° and then moved to the following cooling device. The following processes are the same as described with reference to FIG. 1.

A method for manufacturing a steel tube in accordance with an exemplary embodiment of the present invention will now be described in detail.

Figure 3:
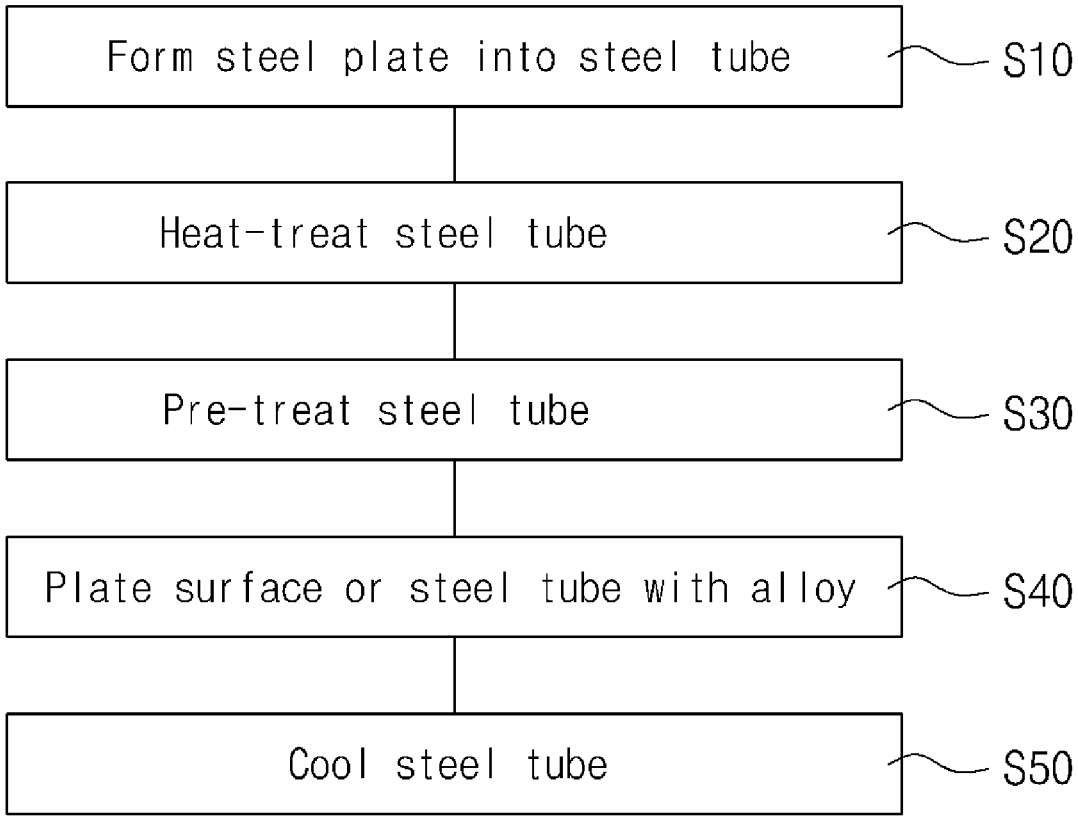
FIG. 3 is a flowchart showing a method for manufacturing a steel tube in accordance with an exemplary embodiment of the present invention.

FIG. 3 is a flowchart showing a method for manufacturing a steel tube in accordance with an exemplary embodiment of the present invention.

As shown in FIG. 3, first, a steel plate is formed into a steel tube (S10). The formed steel tube is heated to a high temperature of 750~850° C. to be heat-treated (S20). Then, the steel tube is annealed to a temperature of 570~620° C. and a reduction atmosphere is provided to perform pre-treatment (S30). The reduction atmosphere is provided by introducing a mixed gas of hydrogen and nitrogen around the steel tube.

Next, a SeAHLume alloy composed of 55 wt % aluminum, 43.4~44.9 wt % zinc, and 0.1~1.6 wt % silicon is molten, and a surface of the steel tube is plated with the molten alloy (S40). The SeAHLume alloy has strong corrosion-resistance. In this process, the steel tube vertically passes through a pot with the molten alloy to be plated with the molten alloy. In order to adjust the thickness of the alloy plated on the steel tube passing through the pot, a gas may be injected into the steel tube. As described above, the vertical moving path of the steel tube may be guided by upper and lower guide rollers.

Then, the steep tube may be cooled to a predetermined temperature or lower. For this purpose, air may be blown onto the plated steel tube or cooling water may be injected to quench the steel tube, thereby performing a cooling step (S50).

In addition, in order to prevent discoloration of the steel tube, a $Cr^{3+}$ chromating process may be performed. As a result, it is possible to manufacture the steel tube having a smooth appearance as well as prevent discoloration of the steel tube.

Since the steel tube manufactured by the method is plated with a SeAHLume alloy having strong corrosion-resistance, it is possible to ensure stable operation when the steel tube is used in a heat exchanger, and so on.

As can be seen from the foregoing, an apparatus for manufacturing a steel tube in accordance with an exemplary embodiment of the present invention has the following advantages.

First, since a steel tube is vertically moved to be plated with an Al—Zn alloy, it is possible to uniformly plate the steel tube with the Al—Zn alloy. In addition, it is possible to remarkably improve corrosion-resistance by plating with a SeAHLume alloy.

Second, since an inert gas is supplied to the steel tube through an upper nozzle device when the steel tube is plated with the alloy, it is possible to readily adjust the thickness of the alloy plated on the steel tube.

Third, the heat-treated steel tube is indirectly annealed in a dual tube in a reduction atmosphere, thereby preventing oxidation such as blacking of the steel tube and improving mechanical properties thereof.

While exemplary embodiments of the present invention have been shown and described, it will be appreciated by those skilled in the art that various changes may be made to these exemplary embodiments without departing from the spirit and scope of the invention as defined by the appended claims and their equivalents.

What is claimed is:

1. An apparatus for manufacturing a steel tube, comprising:

a tube-forming device for forming a steel plate into a steel tube;

a heat treatment device connected in-line to the tube-forming device to heat the steel tube to a high temperature;

a pre-treatment device including a dual tube including an inner tube surrounding the steel tube, and an outer tube disposed around the periphery of the inner tube, a gas injection device supplying a mixed gas of nitrogen and hydrogen into the inner tube, and a cooling water supply device supplying cooling water between the inner tube and the outer tube to slowly cool down and anneal the steel tube and to form a reduction atmosphere; and a plating device including a pot for storing a corrosion-resistant alloy composed of 55 wt % aluminum and 43.4 to 44.9 wt % zinc in a molten state, a level block selectively inserted into the molten alloy to adjust a level of the molten alloy, a plating part into which the molten alloy flows in response to insertion of the level block and through which the steel tube passes substantially vertically, and a partition installed in the pot to divide an upper space of the pot and preventing waves in the molten alloy around the plating part during vertical movement of the level block.

2. The apparatus according to claim 1, wherein upper and lower guide rollers are installed above and below the steel tube passing through the plating part to guide movement of the steel tube.

3. The apparatus according to claim 1, further comprising an upper nozzle device disposed over the plating part and injected a gas for adjusting the thickness of the alloy plated on the steel tube.

* * * * *